BEST AVAILABLE COPY

United States Patent [19]

Baker et al.

[11] Patent Number: 4,910,806

[45] Date of Patent: Mar. 27, 1990

[54] ADJUSTABLE STRAP FOR USE WITH A DIVER'S FACE MASK

[75] Inventors: Thomas R. Baker, Colorado Springs; Jon C. Polkow, Palmer Lake, both of Colo.; Glenn T. Stoll, Miami, Fla.

[73] Assignee: Innovative Scuba Concepts, Inc., Coloroda Springs, Colo.

[21] Appl. No.: 345,834

[22] Filed: May 1, 1989

[51] Int. Cl.[4] ..... A61F 9/02

[52] U.S. Cl. ..... 2/452; 2/428; 2/197; 128/201.11; 351/43

[58] Field of Search ..... 2/428, 429, 430, 452, 2/197, 200; 128/201.11; 351/43, 156, 123

[56] References Cited

U.S. PATENT DOCUMENTS

| | | | |
|---|---|---|---|
| 3,606,648 | 9/1971 | Schuler | 2/452 X |
| 3,672,750 | 6/1972 | Hagen | 351/43 |
| 4,066,077 | 1/1978 | Shamlian | 128/201.11 |
| 4,112,521 | 9/1978 | Uke | 2/452 |
| 4,562,836 | 1/1986 | Perron | 128/201.11 |
| 4,657,364 | 4/1987 | Murrell | 351/123 X |
| 4,692,002 | 9/1987 | Meistrell | 351/156 |
| 4,743,105 | 5/1988 | Tabacchi | 351/156 |
| 4,820,036 | 4/1989 | Seet | 351/43 X |

*Primary Examiner*—Peter Nerbun
*Attorney, Agent, or Firm*—Donald A. Kettlestrings

[57] ABSTRACT

An adjustable strap for use with a diver's face mask includes a flexible, resilient headband having a positive buoyancy in water and an elastic fabric laminated to at least a first side of the headband for comfortably contacting a diver's head to avoid pulling or tangling of the diver's hair.

7 Claims, 2 Drawing Sheets

BEST AVAILABLE COPY

BEST AVAILABLE COPY
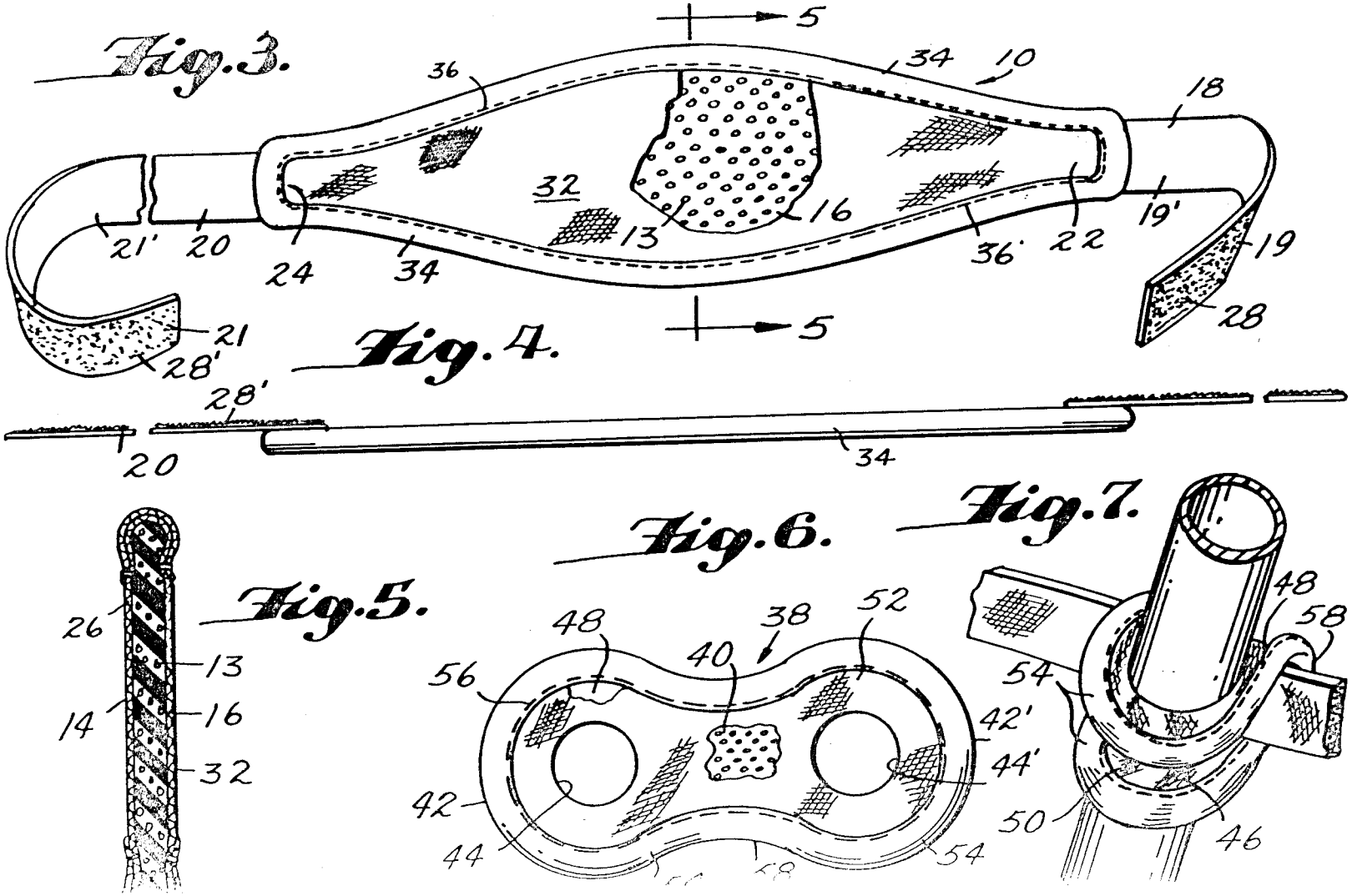

BEST AVAILABLE COPY

ADJUSTABLE STRAP FOR USE WITH A DIVER'S FACE MASK

This invention relates to an adjustable elastic strap for use with a diver's face mask and more particularly to such a strap which is positively buoyant in water and which includes an elastic fabric for comfortably contacting a diver's head without pulling or tangling the diver's hair.

Various types of elastic straps for use with diver's face masks are known, but a common problem with known straps is the uncomfortable pulling and tangling of the diver's hair by the elastic strap material, which is typically neoprene or silicone. Another common problem with known elastic straps is that the straps are not positively buoyant in water. As a result, if the diver's face mask and attached strap are dropped into the water, they quickly sink before they can be retrieved.

It is, therefore, an object of the present invention to provide an adjustable elastic strap for use with a diver's face mask.

Another object is to provide such a strap which is at least partially covered with an elastic fabric for comfortably contacting a diver's head without pulling or tangling the diver's hair.

A further object of the invention is the provision of such a strap which is positively buoyant in fresh water.

Still another object is to provide such a strap which can be quickly and easily adjusted to fit any individual.

Yet another object of the present invention is the provision of such a strap in combination with a positively buoyant snorkel holder for attaching a snorkel to the strap.

Additional objects and advantages of the invention will be set forth in the description which follows, and in part will be obvious from the description, or may be learned by practice of the invention. The objects and advantages are realized and attained by means of the instrumentalities and combinations particularly pointed out in the appended claims.

To achieve these and other objects the present invention provides an adjustable elastic strap for use with a diver's face mask which includes a flexible, resilient headband defining opposed first and second sides; first and second flexible ribbon members attached to the headband; a first elastic fabric attached to the first side of the headband for comfortably contacting a diver's head; and means in operative relationship with the ribbon members for adjustably attaching the strap to the face mask.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

FIG. 3 is a top plan view of the strap with a portion broken away to show the interior closed cell neoprene construction;

FIG. 4 is a side elevation view of the strap;

FIG. 5 is a cross sectional view of the strap taken along the line 5—5 in FIG. 3 and looking in the direction of the arrows;

FIG. 6 is a top plan view of the snorkel holder of this invention in an open position; and FIG. 7 is a fragmentary perspective view showing the snorkel holder wrapped around the strap and holding a conventional snorkel tube to the strap.

Figure 1:
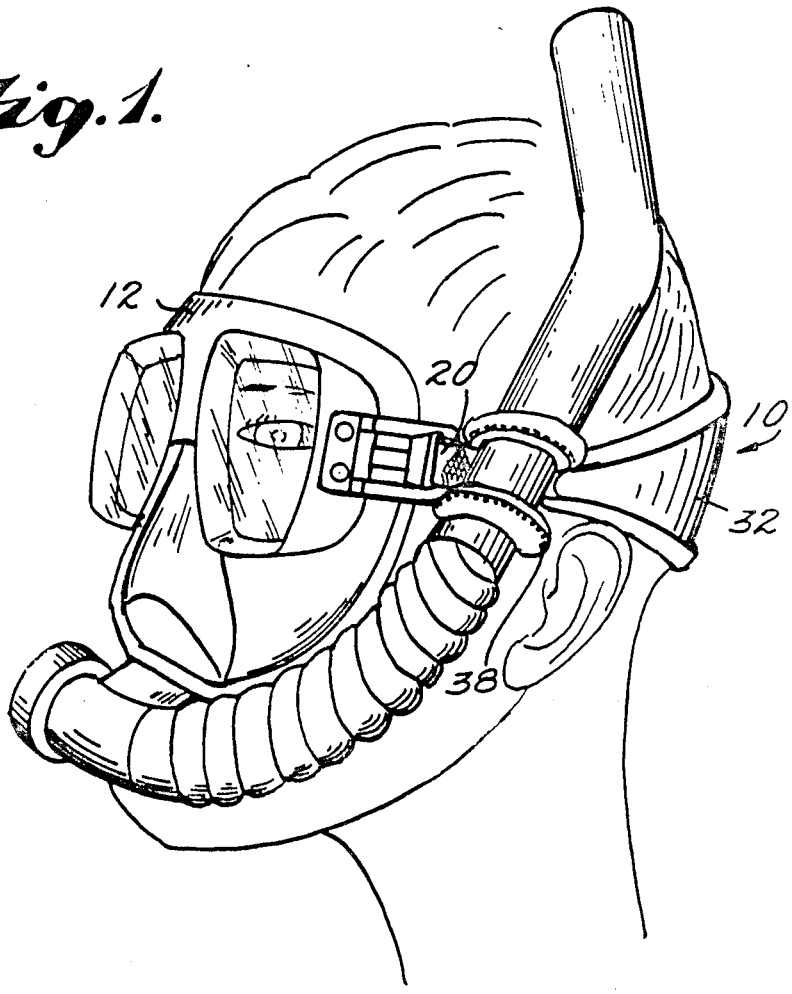
FIG. 1 is a front perspective view of a conventional diver's mask and snorkel having the strap of this inventive attached thereto.
Figure 2:
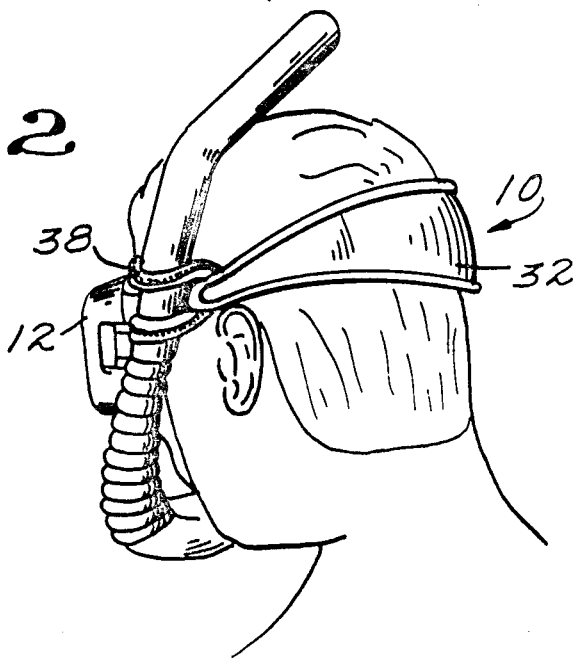
FIG. 2 is a rear perspective view of the assembly shown in FIG. 1.

With reference now to the drawings, wherein like reference characters designate like or corresponding parts throughout the several views, there is shown an adjustable elastic strap 10 for use with a conventional diver's face mask 12. Strap 10 includes a flexible, resilient headband 13 which defines opposed first, inner and second outer sides 14, 16. First and second flexible ribbon members 18, 20 are attached to opposed ends 22, 24, respectively, of headband 13. Ribbon member 18 defines a inner side 19 and an outer side 19', and ribbon member 20 defines an inner side 21 and an outer side 21'.

A first elastic fabric 26 is attached and laminated in a conventional manner to first side 14 of headband 13 for comfortably contacting a diver's head to prevent pulling or tangling of the diver's hair. Means 28, 28', such as a hook and loop type fastener like "VELCRO", are provided in operative relationship with ribbon members 18, 20 for adjustably attaching strap 10 to face mask 12.

Elastic fabric 26 preferably covers substantially all of first side 14 of headband 13 so that fabric 26 comfortably contacts the diver's head and hair to avoid pulling and tangling of the diver's hair.

In accordance with the invention, headband 13 is positively buoyant in fresh and salt water and is comprised of a closed cell elastomer material such as neoprene.

In one preferred embodiment of the invention, elastic fabric 26 includes a plush, closed loop pile, nylon velour, and attaching means 28, 28' include hook type fastening material or elements attached to ribbon members 18, 20, such as the hook material of "VELCRO", whereby the hook type fastening material releasably engages the closed loop pile for enabling face mask 12 to be held in position on ribbon members 18, 20. Ribbon members 18, 20 are preferably looped around post elements of conventional mask 12.

An alternative embodiment of the invention provides that each of ribbon members 18, 20 includes hook type material and loop type material, as in "VELCRO", on each ribbon member. In this embodiment, each of ribbon members 18, 20 can be looped around the post elements of the mask and the hook type material on each ribbon member engages the loop type material on each ribbon member to hold mask 12 in position on the ribbon members.

In accordance with a preferred embodiment of the invention, a second elastic fabric 32 is attached and laminated in a conventional manner to second side 16 of headband 13, and a third elastic fabric 34 is attached to headband 13 and covers edge surfaces 36, 36' of the headband. Fabrics 26, 32 and 34 are preferably comprised of an elastic nylon kit material which is highly elastic in all directions. Fabrics 26 and 32 are conventionally bonded to headband 13 to form a laminate which enables the fabrics to stretch with the stretching of elastic headband 13, and fabric 34 can be sewn to fabrics 26, 32 and/or to headband 13.

This invention also provides for a snorkel holder 38 for use with strap 10. Snorkel holder 38 includes a flexi-

BEST AVAILABLE COPY ble, resilient element 40 defining opposed ends 42, 42' and further defining first and second snorkel-receiving openings 44, 44' adjacent to opposed ends 42, 42', respectively. Element 40 further defines opposed first and second surfaces 46, 48, and a fourth elastic fabric 50 is attached and laminated in a conventional manner to and substantially covers first surface 46. A fifth elastic fabric 52 is attached and laminated in a conventional manner to and substantially covers second surface 48, and a sixth elastic fabric 54 is attached to element 40 and covers edge surfaces 56 of element 40. A cross section of holder 38 is identical to the cross section of strap 10, illustrated in FIG. 5.

Element 40 is preferably substantially in the shape of a figure eight and defines a narrowed central portion 58. Snorkel holder 38 can be bent about narrowed central portion 58 and positioned at least partially around one of ribbon members 18, 20 with openings 44, 44' in alignment with each other for receiving and holding a conventional snorkel tube in position on strap 10. This is best illustrated in FIG. 7.

Element 40 is positively buoyant in fresh and salt water and is comprised of a closed cell elastomer material, such as neoprene. Fabrics 50, 52 and 54 are preferably comprised of highly elastic nylon material which is capable of stretching in all directions. Fabrics 50, 52 are bonded to element 40 in a conventional manner to form a laminate so that fabrics 50, 52 and 54 stretch as element 40 stretches. The positive buoyancy of holder 38 prevents the holder from sinking in the water if the holder is accidentally dropped by the user.

This invention provides for an adjustable elastic strap for use with a diver's face mask and a snorkel holder for use with the strap. The headband of the strap is covered with a fabric to contact the diver's head and hair in a comfortable manner to avoid uncomfortable pulling and tangling of the diver's hair. Because the strap and holder are both positively buoyant in water, if the face mask is dropped into the water the rate of sinking of the mask is greatly reduced so that the mask and attached strap and holder can be retrieved before they are lost.

The invention in its broader aspects is not limited to the specific details shown and described, and departures may be made from such details without departing from the principles of the invention and without sacrificing its chief advantages.

What is claimed is:

1. An adjustable strap for use with a diver's face mask, said strap comprising:

a flexible, resilient headband defining a first, inner side for positioning against the diver's head;

said headband further defining a second, outer side opposed to said first, inner side;

first and second flexible ribbon members attached to said headband, each of said ribbon members defining an inner and an outer side;

a first elastic closed loop pile fabric attached to said first, inner side of said headband for comfortably contacting the diver's head; and hook-type fastening material attached to said inner sides of said ribbon members, whereby said hook-type fastening material releasably engages said closed loop pile for enabling said face mask to be held in position on said ribbon members.

2. A strap as in claim 1 wherein said fabric covers substantially all of said first, inner side of said headband.

3. A strap as in claim 2 wherein said headband is comprised of a closed cell elastomer polymer and wherein said headband is positively buoyant in fresh water.

4. An adjustable strap for use with a diver's face mask, said strap comprising:

a flexible, resilient headband positively bouyant in fresh water and defining opposed first, inner and second, outer sides;

first and second flexible ribbon members attached to said headband;

a first elastic fabric attached to and covering substantially all of said first, inner side of said headband for comfortably contacting a diver's head;

means in operative relationship with said ribbon members for adjustably attaching said strap to said face mask wherein said attaching means include hook and loop type fastening material attached to said ribbon members; and a second elastic fabric attached to said second side of said headband and a third elastic fiber attached to said headband and covering edge surfaces of said headband.

5. A strap as in claim 4 wherein said first elastic fabric is nylon.

6. An adjustable strap for use with a diver's face mask, said strap comprising:

a flexible, resilient headband positively bouyant in fresh water and defining opposed first, inner and second, outer sides;

first and second flexible ribbon members attached to said headband;

a first elastic fabric attached to and covering substantially all of said first, inner side of said headband for comfortably contacting a diver's head, said elastic fabric including a closed loop pile;

means in operative relationship with said ribbon members for adjustably attaching said strap to said face mask wherein said attaching means include hook type fastening material attached to said ribbon members whereby said hook type fastening material releasably engages said closed loop pile for enabling said face mask to be held in position on said ribbon members; and a second elastic fabric attached to said second side of said headband and a third elastic fabric attached to said headband and covering edge surfaces of said headband.

7. A strap as in claim 6 wherein said first elastic fabric is nylon.

* * * * *